US006673502B2

(12) United States Patent
Takahashi et al.

(10) Patent No.: US 6,673,502 B2
(45) **Date of Patent: *Jan. 6, 2004**

(54) CARRIER FOR DEVELOPMENT OF ELECTROSTATIC LATENT IMAGE, ELECTROSTATIC LATENT IMAGE DEVELOPER AND IMAGE FORMING METHOD

(75) Inventors: Sakon Takahashi, Kanagawa (JP); Hiroshi Nakazawa, Kanagawa (JP); Tomohito Nakajima, Kanagawa (JP); Masahiro Takagi, Kanagawa (JP); Atsuhiko Eguchi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 110 days.

This patent is subject to a terminal disclaimer.

(21) Appl. No.: 09/977,300

(22) Filed: Oct. 16, 2001

(65) Prior Publication Data

US 2002/0160293 A1 Oct. 31, 2002

(30) Foreign Application Priority Data

Jan. 17, 2001 (JP) ..... 2001-008666

(51) Int. Cl.[7] ..... G03G 9/113

(52) U.S. Cl. ..... 430/111.35; 430/111.1; 430/120; 430/124; 430/126

(58) Field of Search ..... 430/111.35, 111.31, 430/111.32, 111.33, 111.34, 111.41, 122, 111.1, 120, 124, 126

(56) References Cited

U.S. PATENT DOCUMENTS 5,654,120 A * 8/1997 Hakata et al. ..... 430/111.34
5,821,023 A * 10/1998 Shibuya et al. ..... 430/120
6,022,662 A * 2/2000 Matsumura et al.
6,447,972 B1 * 9/2002 Nakajima et al. ..... 430/111.35

FOREIGN PATENT DOCUMENTS

| | | | | |
|---|---|---|---|---|
| JP | A 59-104664 | | 6/1984 | |
| JP | A 60-66264 | | 4/1985 | |
| JP | A 61-80161 | | 4/1986 | |
| JP | A 61-80162 | | 4/1986 | |
| JP | A 61-80163 | | 4/1986 | |
| JP | 5-150559 | * | 6/1993 | ..... 430/111.1 |
| JP | A 7-114219 | | 5/1995 | |

OTHER PUBLICATIONS

Derwent English– Language, Machine– Assisted Translation of JP 5–150559 (Pub. Jun. 1993).*

Japanese Patent Office Machine– Assisted Translation of JP 5–150559 (pub Jun. 1993).*

* cited by examiner

*Primary Examiner*—Janis L. Dote
(74) *Attorney, Agent, or Firm*—Oliff & Berridge, PLC

(57) ABSTRACT

A carrier for the development of an electrostatic latent image, comprising a core material and a resin coating the core material therewith, wherein the coating resin comprises a copolymer of at least four kinds of monomers including: (1) a monomer containing a carboxyl group; (2) an acrylic acid alkylester monomer or methacrylic acid alkylester monomer, containing a $C_1$–$C_3$ linear alkyl group; (3) an acrylic acid alkylester monomer or methacrylic acid alkylester monomer, containing a $C_4$–$C_{10}$ linear alkyl group or $C_3$–$C_{10}$ branched alkyl group; and (4) a monomer containing fluorine. Also disclosed is a two-component developer for the development of an electrostatic latent image, comprising a toner and the carrier.

15 Claims, No Drawings

CARRIER FOR DEVELOPMENT OF ELECTROSTATIC LATENT IMAGE, ELECTROSTATIC LATENT IMAGE DEVELOPER AND IMAGE FORMING METHOD

FIELD OF THE INVENTION

The present invention relates to a carrier for the development of electrostatic latent image for use in electrophotography, electrostatic recording, electrostatic printing, etc. The invention also relates to a developer for the development of electrostatic latent image comprising the carrier and to an image forming method using the developer.

BACKGROUND OF THE INVENTION

A method which comprises making image data visible via electrostatic image such as electrophotography has wide application at present. Electrophotography has heretofore normally employed a process which comprises forming an electrostatic latent image on a photoreceptor or electrostatic recording material by various means, and then allowing electroscopic particulate material called toner to be attached to the electrostatic latent image to develop and make the electrostatic latent image visible. The toners to be used for this purpose can be roughly divided into two groups. That is, one of them is a two-component developer arranged such that a supporting particle such as carrier and a particulate toner are mixing by each other to cause electrification so that the toner is provided with a proper amount of positive or negative charge. The other of them is one-component developer comprising a toner alone such as magnetic toner. In particular, the two-component developer can provide the carrier itself with functions such as agitation, conveyance and electrification, making it possible to separate functions required for developer. Thus, the two-component developer has found wide application because of easy design.

However, the two-component developer for use in frictional electrification is readily subject to change of electrification level when affected by environmental change. In general, high electrification can easily occur under low temperature and low humidity conditions while low electrification can easily occur under high temperature and high humidity conditions. Thus, the two-component developer is disadvantageous in that environmental change leads to the reduction of density in the case of high electrification or to the occurrence of fog in the case of low electrification.

Processes for the preparation of a toner can be roughly divided into two groups, i.e., a process involving conventional dry melt-knead grinding method and a wet process involving granulation of a toner in a liquid. The wet process has been given more attention from the standpoint of reduction of diameter of toner, sharpness of particle size distribution, freedom of shape control, reduction of energy cost of production, etc. However, since granulation is effected in a liquid, a hydrophilic group can be easily left on the surface of the toner, causing moistening under high humidity conditions and hence deteriorating chargeability. Therefore, the conventional developer comprising a toner obtained by such a wet process is disadvantageous in that it exhibits deteriorated chargeability under high humidity conditions.

The change of electrification (environmental dependence) of the carrier becomes larger as the chargeability of the coating resin increases. For example, a carrier comprising a polymethyl methacrylate as a coating resin has a higher electrification level but exhibits a higher environmental dependence than that comprising a polystyrene as a coating resin. In other words, a resin material containing a group having a high polarity has a high electrification level but exhibits a high environmental dependence while a resin material having a low polarity has a low environmental dependence but has a lower electrification level. Thus, it is difficult to allow both the toner and carrier to keep desired electrification level and provide chargeability which has little environmental dependence.

A carrier is required to have a good electrification-maintaining property. In other words, the carrier is required to maintain desired electrification level over an extended period of time. The deterioration of carrier has been heretofore considered attributed to the following two causes.

Firstly, the deterioration of carrier is attributed to the fixing of toner components to the surface of the carrier coating resin. When a toner and external additives having a polarity opposite to that of the carrier are attached to the carrier, the chargeability of the carrier is deteriorated. Further, since the toner is insulating, the carrier to which the toner has been attached shows a raised resistivity.

Secondly, when the coated carrier is subject to stress with time, the coating resin is peeled off to reduce the amount of the coating resin. As a result, the carrier exhibits deteriorated chargeability. Further, when the core material is exposed, the carrier exhibits deteriorated chargeability and lowered resistivity.

In order to solve these problems, it has been proposed to use a fluororesin or silicone resin as coating resin so that the surface energy of the coating resin can be reduced to prevent pollution of the surface of carrier or raise the strength of the coating resin so that the peeling off or loss of the coat layer can be prevented. However, since such a low surface energy material has a deteriorated adhesion to core material, it is very difficult to provide the coating resin with both pollution resistance and peeling resistance.

JP-A-2-114271 (The term "JP-A" as used herein means an "unexamined published Japanese patent application") proposed a carrier coated with a copolymer of (meth)acrylic acid ester monomer with a monomer having a carboxyl group for the purpose of enhancing the adhesion of coating resin to improve the electrification maintaining property. The carboxyl group to be used in this proposal is effective to enhance the negative chargeability of carrier and hence the adhesion to core material such as metal and durability. However, the carboxyl group, which is a hydrophilic group, comes up to the surface of the coating resin to exhibit hygroscopicity, deteriorating chargeability and hence making it easy for the carrier to be contaminated to disadvantage.

JP-A-61-80161, JP-A-61-80162, and JP-A-61-80163 proposed that when the surface of a carrier core material is coated with a copolymer of nitrogen-containing fluorinated alkyl (meth)acrylate and vinyl monomer or a copolymer of fluorinated alkyl (meth)acrylate and nitrogen-containing vinyl monomer, a coated carrier having a relatively prolonged life which can difficultly be contaminated by toner or external additives can be provided. However, this approach is disadvantageous in that since a fluororesin has an insufficient chargeability, the resulting carrier has a raised environmental dependence when copolymerized with a nitrogen-containing vinyl monomer or methyl methacrylate ester monomer having a highly chargeable polar group.

Paying attention to methacrylic acid ester monomer for the purpose of solving the problem of environmental dependence, JP-A-59-104664 proposed a carrier coated with a methacrylic acid cycloalkyl ester polymer having an excellent moisture resistance. However, this carrier has a low electrification level, high brittleness and a deteriorated adhesion to core material as compared with that coated with methyl methacrylate.

In order to solve the foregoing problem, JP-A-7-114219 proposed a carrier coated with a copolymer of methacrylic acid cycloalkyl ester and methyl methacrylate. However, cycloalkyl ester is brittle and thus can be easily peeled off. Further, when the composition ratio of methyl methacrylate is increased, the resulting environmental stability is deteriorated, making it impossible to accomplish desired durability and environmental dependence at the same time.

Further, JP-A-60-66264 proposed a carrier coated with a copolymer containing tertiary butyl acrylate component and methyl acrylate component. The incorporation of two or more such (meth)acrylic acid esters makes it easier to control chargeability than coated carrier comprising a homopolymer alone. However, since this coating exhibits deteriorated adhesion to core material and becomes brittle similarly to cycloalkyl ester, the resulting coated carrier exhibits deteriorated durability and leaves something to be desired in electrification-maintaining property.

It is thus very difficult to satisfy the reliability requirements, i.e., electrification level, electrification-maintaining property, environmental stability, pollution resistance and durability, of carrier at the same time.

SUMMARY OF THE INVENTION

It is therefore an object of the invention to provide a carrier for the development of an electrostatic latent image excellent in electrostatic property, electrification-maintaining property, environmental stability, transferability, durability and pollution resistance.

Another object of the invention is to provide a developer comprising the carrier.

A still other object of the invention is to provide a method for forming a high quality image.

Other objects and effects of the present invention will become apparent from the following description.

The above-described objects of the present invention have been achieved by providing the following carriers, developers, and image forming methods.

1. A carrier for the development of electrostatic latent image comprising a core material and a resin for coating the core material therewith, wherein the coating resin comprises a copolymer of at least four kinds of monomers including:

(1) a monomer containing a carboxyl group;

(2) an acrylic acid alkylester monomer or methacrylic acid alkylester monomer containing a $C_1$–$C_3$ linear alkyl group;

(3) an acrylic acid alkylester monomer or methacrylic acid alkylester monomer containing a $C_4$–$C_{10}$ linear alkyl group or $C_3$–$C_{10}$ branched alkyl group; and (4) a monomer containing fluorine.

2. The carrier for the development of electrostatic latent image according to Clause 1, wherein the proportion of the carboxyl group-containing monomer is from 0.1 to 20.0 parts by weight per 100 parts by weight of the copolymer, the proportion of the fluorine-containing monomer is from 0.1 to 60.0 parts by weight per 100 parts by weight of the copolymer, the balance is a (meth)acrylic acid alkylester monomer, and the ratio of the acrylic acid alkylester monomer or methacrylic acid alkylester monomer containing a $C_1$–$C_3$ linear alkyl group (2) to the acrylic acid alkylester monomer or methacrylic acid alkylester monomer containing a $C_4$–$C_{10}$ linear alkyl group or $C_3$–$C_{10}$ branched alkyl group (3) is from 10:90 to 90:10.

3. The carrier for the development of electrostatic latent image according to Clause 1 or 2, wherein the fluorine-containing monomer (4) is a fluoroalkyl (meth)acrylate monomer.

4. The carrier for the development of electrostatic latent image according to any one of Clauses 1 to 3, wherein the core material has a shape factor SF1 of not greater than 125, a true specific gravity of from 3 to 5 g/cm$^3$ and a saturated magnetization of not smaller than 40 emu/g.

5. The carrier for the development of electrostatic latent image according to any one of Clauses 1 to 4, wherein the core material is a magnetic powder-dispersed spherical core material.

6. A two-component developer for the development of electrostatic latent image comprising a toner and a carrier, wherein the toner comprises a binder resin containing a carboxyl group-containing monomer and the carrier is according to any one of Clauses 1 to 5.

7. The two-component developer for the development of electrostatic latent image according to Clause 6, wherein the content of the carboxyl group-containing monomer is from 0.05 to 5 parts by weight per 100 parts by weight of the binder resin.

8. The two-component developer for the development of electrostatic latent image according to Clause 6 or 7, wherein the toner is produced by a wet process.

9. An image formation method comprising:

forming an electrostatic latent image on an electrostatic latent image holding member;

developing the electrostatic latent image with a developer on a developer holding member to form a toner image;

transferring the toner image to a transfer material; and fixing the toner image on the transfer material, wherein the developer contains a carrier according to any one of Clauses 1 to 5.

10. An image formation method comprising:

forming an electrostatic latent image on an electrostatic latent image holding member;

developing the electrostatic latent image with a developer on a developer holding member to form a toner image;

transferring the toner image to a transfer material; and fixing the toner image on the transfer material, wherein the developer is according to any one of Clauses 6 to 8.

11. The image formation method according to Clause 9 or 10, wherein the developer holding member has a fine unevenness having Rz of from 15 to 25 $\mu$m and Ra of from 1 to 5 $\mu$m.

DETAILED DESCRIPTION OF THE INVENTION

The present invention will be further described hereinafter.

The inventors made extensive studies of solution to the foregoing problems. As a result, it was found that the use of a copolymer comprising in combination specific monomers as a coating resin for carrier makes it possible to provide a carrier for the development of electrostatic latent image which exhibits an excellent chargeability under high humidity conditions, less rise in electrification under low humidity conditions and excellent electrification-maintaining property, is not subject to release of coat layer and can hardly attract toner or external additives and the coating of a specific core material with the foregoing coating resin makes it possible to further improve the electrification-maintaining property of carrier. It was also found that the use of a specific toner with the foregoing carrier makes it possible to improve transferability in addition to the foregoing properties and hence form a high quality image.

The coating resin for carrier to be used herein is obtained by the copolymerization of at least four kinds of monomers including: a monomer containing a carboxyl group; a (meth) acrylic acid alkylester monomer containing a $C_1$–$C_3$ linear alkyl group; a (meth)acrylic acid alkylester monomer containing a $C_4$–$C_{10}$ linear alkyl group or $C_3$–$C_{10}$ branched alkyl group; and a monomer containing fluorine.

In the coating resin of the invention, the carboxyl group-containing monomer is effective to maintain electrification level and improve the adhesivity of the coating resin to the core material, securing desired durability. However, since the coating resin comprising a carboxyl group-containing monomer is hydrophilic and highly hygroscopic, it is disadvantageous in that the coating resin exhibits a deteriorated chargeability under high humidity. It was then found that the incorporation of a (meth)acrylic acid alkylester monomer containing a $C_4$–$C_{10}$ linear alkyl group or $C_3$–$C_{10}$ branched alkyl group is effective to eliminate the foregoing disadvantage and hence improve environmental stability. In other words, the foregoing (meth)acrylic acid alkylester monomer containing a linear or branched alkyl group having many carbon atoms is hydrophobic and thus exhibits no deterioration in chargeability under high humidity conditions. The (meth)acrylic acid alkylester monomer containing a linear alkyl group having many carbon atoms exhibits a lowered glass transition point. On the contrary, the (meth)acrylic acid alkylester monomer containing a branched alkyl group exhibits a raised glass transition point and thus is effective to provide the carrier with desired fluidity. However, these (meth)acrylic acid alkylester monomers can deteriorate the strength of the film and thus cause malelectrification when the toner concentration is high. In order to eliminate this defect, the incorporation of a (meth)acrylic acid alkylester monomer containing a $C_1$–$C_3$ linear alkyl group is effective. This (meth)acrylic acid alkylester monomer has a high environmental dependence. However, the combined use of this (meth)acrylic acid alkylester monomer and the (meth) acrylic acid alkylester monomer containing a $C_4$–$C_{10}$ linear alkyl group or $C_3$–$C_{10}$ branched alkyl group makes it possible to eliminate this defect. When the carboxyl group-containing monomer is used, the resulting carrier exhibits a reduced contact angle with respect to water and thus is more subject to contamination by toner or external additives. It was then further found that the incorporation of a fluorine-containing monomer makes it possible to enhance the contact angle of the coating resin and hence improve pollution resistance and maintain desired chargeability over an extended period of time.

These monomers can be incorporated in the same copolymer to secure the foregoing properties. As the copolymerization method there may be used a polymerization method such as random copolymerization and graft copolymerization. The graft copolymerization method is advantageous in that the desired function can be easily exhibited, the adhesion to the core material can be easily improved and Tg of the coating resin can be easily enhanced. However, even if homopolymers of these monomers are blended, the resulting coating resin exhibits deteriorated compatibility, making it impossible to obtain the foregoing properties.

Examples of the carboxyl group-containing monomer employable herein include unsaturated carboxylic acids such as (meth)acrylic acid, vinylacetic acid, allylacetic acid and 10-undecenacetic acid, styrene derivatives such as carboxylstyrene, and compounds having two carboxyl groups such as p-carboxylstyrene.

The amount of the carboxyl group-containing monomer to be incorporated is preferably from 0.1 to 15.0% by weight, more preferably from 0.5 to 10.0% by weight based on the total amount of the monomers constituting the coating resin from the standpoint of adhesion and environmental stability of coating resin. When the amount of the carboxyl group-containing monomer to be incorporated falls below 0.1% by weight, the electrification level is insufficient, deteriorating the adhesion of the coating resin to the core material and hence making it impossible to secure desired durability. On the contrary, when the amount of the carboxyl group-containing monomer to be incorporated exceeds 15% by weight, the resulting coating resin exhibits a raised viscosity that makes it difficult to form a uniform film on the core material and hence impairs the environmental stability of the coating resin.

Examples of the (meth)acrylic acid alkylester monomer containing a $C_1$–$C_3$ linear alkyl group employable herein include methyl (meth)acrylate, ethyl (meth)acrylate, and n-propyl (meth)acrylate.

Examples of the (meth)acrylic acid alkylester monomer containing a $C_4$–$C_{10}$ linear alkyl group or $C_3$–$C_{10}$ branched alkyl group employable herein include isopropyl (meth) acrylate, n-butyl (meth)acrylate, tertiary butyl (meth) acrylate, isobutyl (meth)acrylate, tertiary pentyl (meth) acrylate, n-pentyl (meth)acrylate, isopentyl (meth)acrylate, n-hexyl (meth)acrylate, isohexyl (meth)acrylate, and cyclohexyl (meth)acrylate.

The amount of the (meth)acrylic acid alkylester monomer to be used herein is the balance except the amount of the previously mentioned carboxyl group-containing monomer, the fluorine-containing monomer described later and additive monomers, if added to the four monomers. The ratio of the (meth)acrylic acid alkylester monomer containing a $C_1$–$C_3$ linear alkyl group to the (meth)acrylic acid alkylester monomer containing a $C_4$–$C_{10}$ linear alkyl group or $C_3$–$C_{10}$ branched alkyl group is adjusted to from 10:90 to 90:10. In this arrangement, the foregoing chargeability, film strength and fluidity can be well balanced. The preferred range of monomer ratio is from 20:80 to 80:20.

Preferred examples of the fluorine-containing monomer employable herein include fluoroalkyl (meth)acrylate monomers containing fluorine such as tetrafluoropropyl methacrylate, pentafluoropropyl methacrylate, octafluoropentyl methacrylate, perfluorooctylethyl methacrylate and trifluoroethyl methacrylate.

The amount of the fluorine-containing monomer to be used herein is from 0.1 to 60.0% by weight, preferably from 0.5 to 50.0% by weight based on the total weight of the monomers constituting the coating resin. When the amount of the fluorine-containing monomer falls below 0.1% by weight, desired pollution resistance cannot be secured. On the contrary, when the amount of the fluorine-containing monomer exceeds 60.0% by weight, the adhesion of the coating resin to the core material is deteriorated and the chargeability of carrier is deteriorated to disadvantage.

As the method for the copolymerization of these monomers there may be used random copolymerization method, graft copolymerization method or the like. The graft copolymerization method is advantageous in that the desired function can be easily exhibited, the adhesion to the core material can be easily improved and the glass transition point of the coating resin can be easily enhanced.

The carrier core material to be used herein is not specifically limited. In practice, however, a magnetic metal such as iron, steel, nickel and cobalt, a magnetic oxide such as ferrite and magnetite, glass bead, etc. can be used. Among these materials, the magnetic materials are preferably used when development is accomplished by magnetic brush method. The volume-average particle diameter of the carrier core material is from 10 $\mu$m to 150 $\mu$m, preferably from 20 $\mu$m to 100 $\mu$m. The true specific gravity of the carrier core material is from about 4 to 6 g/cm$^3$.

As the carrier core material there may be alternatively used a spherical core having a magnetic powder dispersed in a resin. Since this spherical core has a small specific gravity, it is advantageous in that stress with respect to toner and carrier can be inhibited. Thus, this spherical core can be used in combination with the foregoing coating resin to secure desired electrification-maintaining property and environmental stability. Examples of the resin to be used in the magnetic powder-dispersed carrier core include crosslinked resins such as phenolic resin and melamine resin, and thermoplastic resins such as polyethylene and polymethyl methacryate.

As the spherical core there may be used a material having the same average particle diameter as that of the foregoing carrier core material. The shape factor SF 1 of the spherical core is preferably not greater than 125. The true specific gravity of the spherical core is preferably from 3 to 5 g/cm$^3$. The saturated magnetization of the spherical core is preferably not smaller than 40 emu/g.

For the measurement of shape factor SF1, optical microscopic image of spherical core sprayed on a slide glass is taken into a luzex image analyzer via a video camera. One hundred or more spherical core particles were then measured for maximum length (ML) and projected area (A). The measured values of $ML^2/A\times100\times\pi/4$ were averaged to determine shape factor SF1.

The coated amount of the coating resin for carrier of the invention is preferably from 0.05 to 5.0% by weight so that image quality, secondary hindrance and chargeability can be well balanced. In order to apply the coating resin to the electrification-imparting member, the coated amount and coating method can be properly predetermined to obtain a proper thickness taking into account charged amount and electrification-maintaining property.

The solvent to be used in the starting material solution from which the resin coat layer is formed is not specifically limited so far as it can dissolve the matrix resin therein. Examples of the solvent employable herein include aromatic hydrocarbons such as xylene and toluene, ketones such as acetone and methyl ethyl ketone, ethers such as tetrahydrofuran and dioxane, and halides such as chloroform and carbon tetrachloride.

Representative examples of the method for forming the coating resin on the surface of the carrier core material or electrification-imparting member include a dipping method involving the dipping of carrier core material powder or electrification-imparting member in a starting material solution for forming a resin coat layer (solvent contains a proper amount of matrix resin, particulate resin, electrically-conductive particulate material, etc.), a spraying method involving the spraying of a resin coat layer-forming solution onto the surface of the carrier core material or electrification-imparting member, a fluidized bed method which comprises spraying a resin coat layer-forming solution onto a carrier coat material being suspended on flowing air, and a kneader coating method which comprises mixing a carrier core material with a resin coat layer-forming solution in a kneader, and then removing the solvent therefrom. However, the present invention is not limited to methods involving the use of solution. Depending on the carrier core material or electrification-imparting member to which the coating resin is applied, a powder coat method involving the heating and mixing with the resin powder may be properly employed.

In the invention, a two-component developer comprising a toner and a carrier can be used. Since as the carrier of the invention there is used a coating resin containing a carboxyl group-containing monomer, the carboxyl group, which is an anionic group, enhances the negative electrostatic property of the carrier, deteriorating the chargeability thereof with respect to the negative toner. In the invention, when the foregoing carrier is used, the carboxyl group-containing monomer can be used as binder resin for toner to improve the negative electrostatic property of the toner and hence maintain the chargeability of the developer. As the carboxyl group-containing monomer to be used as toner binder resin there may be used one exemplified as carrier coating resin. The carboxyl group-containing monomer may have the same or different structure from the carrier coating resin. So far as the carboxyl group is contained, the same effect can be exerted.

The particulate toner of the invention preferably has a shape factor SF1 of from 100 to 135. In order to prepare such a toner, a wet process is preferably used. Examples of such a wet process include (1) an emulsion polymerization coagulation process which comprises mixing a particulate resin dispersion obtained by the emulsion polymerization of polymerizable monomers of binder resin, a colorant dispersion, a release agent dispersion, and optionally a dispersion of charge controller, etc. to form coagulated particles, and then heating the coagulated particles so that they are coalesced to obtain a particulate toner, (2) a suspension polymerization process which comprises polymerizing a solution of a polymerizable monomer for obtaining a binder resin, a colorant, a release agent, and optionally a charge controller, etc. in the form of suspension in an aqueous solvent to obtain a particulate toner, and (3) a solution suspension process which comprises suspending a solution of a binder resin, a colorant, a release agent, and optionally a charge controller, etc. in an aqueous solvent to cause granulation. Optimum among these wet processes is emulsion polymerization coagulation process.

Examples of the binder resin to be used in the toner of the invention include homopolymer and copolymers of styrenes such as styrene and chlorostyrene, monoolefins such as ethylene, propylene, butylene and isoprene, vinylesters such as vinyl acetate, vinyl propionate, vinyl benzoate and vinyl butyrate, unsaturated carboxylic acids such as (meth)acrylic acid, vinylacetic acid, allylacetic acid and 10-undecenic acid, styrene derivatives such as carboxylstyrene, $\alpha$-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate, vinyl ethers such as vinyl methyl ether, vinyl ethyl ether and vinyl butyl ether, and vinyl ketones such as vinyl methyl ketone, vinyl hexyl ketone and vinyl isopropyl ketone. Particularly representative examples of the binder resin include polystyrene, styrene-acrylic acid alkyl copolymer, styrene-methacrylic acid alkyl copolymer, styrene-acrylonitrile copolymer, styrene-butadiene copolymer, styrene-maleic anhydride copolymer, polyethylene, and polypropylene. Further examples of the binder resin include polyester, polyurethane, epoxy resin, silicone resin, polyamide, modified rosin, and paraffin wax.

Representative examples of the colorant to be incorporated in the toner of the invention include magnetic powder such as magnetite and ferrite powder, carbon black, aniline black, chalcoyl blue, chrome yellow, ultramarine blue, Du Pont oil red, quinoline yellow, methylene blue chloride, phthalocyanine blue, malachite green oxalate, lamp black, rose bengale, C.I. pigment red 48:1, C.I. pigment red 122, C.I. pigment red 57:1, C.I. pigment yellow 97, C.I. pigment yellow 17, C.I. pigment yellow 12, C.I. pigment yellow 128, C.I. pigment yellow 151, C.I. pigment yellow 155, C.I. pigment yellow 173, C.I. pigment yellow 180, C.I. pigment yellow 185, C.I. pigment blue 15:1, and C.I. pigment blue 15:3.

Representative examples of the release agent to be incorporated in the toner of the invention include low molecular polyethylene, low molecular polypropylene, Fischer-Tropsch wax, montan wax, carnauba wax, rice wax, and candelilla wax.

The toner for the development of electrostatic latent image of the invention may comprise a charge controller incorporated therein as necessary. As the charge controller there may be used a known charge controller. In practice, however, azo-based metal complex compounds, metal complex compounds of salicylic acid or resin type charge controllers containing a polar group may be used. Preferably, a material which can difficultly be dissolved in water is preferably used from the standpoint of control over ionic strength and reduction of pollution by waste water. The toner of the invention may be a magnetic toner containing a magnetic material or a non-magnetic toner free of magnetic material.

These particulate toners may a magnetic material powder incorporated therein besides additives such as known charge controller, fluidity improver and fixing aid as necessary. The particle diameter of the toner tends to decrease as the image quality improves. The average particle diameter of the toner is from 2 to 12 $\mu$m, preferably from 5 to 10 $\mu$m.

The magnetic sleeve for carrying developer to be used herein may be made of a known magnetic material. In practice, however, the surface of the sleeve can be provided with a fine unevenness having Rz of from 15 to 25 $\mu$m and Ra of from 1 to 5 $\mu$m. In this arrangement, the developer can be provided with desired conveyance stability, the carrier can be prevented from flying, and a good image free from defects can be formed. Most commonly used sleeves have Rz of not greater than 10 $\mu$m. When a carrier having a small diameter, a carrier having a small shape factor (shape factor SF1 of not greater than 125), a toner having a small diameter and a toner having a small shape factor (shape factor SF1 of not greater than 135) are used singly or in combination, the resulting developer exhibits an unstable conveyability. Therefore, in the case where these developers are used, the use of the foregoing magnetic sleeve is effective for the maximum accomplishment of the properties thereof.

The method for forming an image of the invention comprises a step of forming an electrostatic latent image on an electrostatic latent image holding member, a step of developing the electrostatic latent image with a developer on a developer holding member to form a toner image, a step of transferring the toner image to a transfer material, and a step of fixing the toner image on the transfer material, characterized in that as the developer there is used one containing the foregoing carrier, whereby the environmental dependence can be suppressed to form a good image.

EXAMPLES

The present invention will be illustrated in greater detail with reference to the following Examples, but the invention should not be construed as being limited thereto. All the "parts" and "%" are given by weight unless otherwise indicated.

Preparation of Coating Resin A 38 parts by weight of methyl methacrylate, 50 parts by weight of isobutyl methacrylate, 2 parts by weight of methacrylic acid, and 10 parts by weight of perfluorooctylethyl methacrylate are subjected to random copolymerization by solution polymerization with a toluene solvent obtain a coating resin A having a weight-average molecular weight Mw of 52,000.

Preparation of Coating Resin B 38 parts by weight of methyl methacrylate, 40 parts by weight of tertiary butyl methacrylate, 2 parts by weight of methacrylic acid, and 20 parts by weight of perfluorooctylethlyl methacrylate are subjected to random copolymerization by solution polymerization with a toluene solvent to obtain a coating resin B having a weight-average molecular weight Mw of 49,000.

Preparation of Coating Resin C 50 parts by weight of methyl methacrylate and 50 parts by weight of isobutyl methacrylate are subjected to random copolymerization by solution polymerization with a toluene solvent to obtain a coating resin C having a weight-average molecular weight Mw of 53,000.

Preparation of Coating Resin D 98 parts by weight of methyl methacrylate and 2 parts by weight of methacrylic acid are subjected to random copolymerization by solution polymerization with a toluene solvent to obtain a coating resin D having a weight-average molecular weight Mw of 51,000.

Preparation of Coating Resin E 50 parts by weight of methyl methacrylate, 40 parts by weight of isobutyl methacrylate, and 10 parts by weight of perfluorooctylethyl methacrylate are subjected to random copolymerization by solution polymerization with a toluene solvent to obtain a coating resin E having a weight-average molecular weight Mw of 48,000.

Preparation of Coating Resin F 88 parts by weight of methyl methacrylate, 2 parts by weight of methacrylic acid, and 10 parts by weight of perfluorooctylethyl methacrylate are subjected to random copolymerization by solution polymerization with a toluene solvent obtain a coating resin F having a weight-average molecular weight Mw of 49,000.

Preparation of Coating Resin G 88 parts by weight of isobutyl methacrylate, 2 parts by weight of methacrylic acid, and 10 parts by weight of perfluorooctylethyl methacrylate are subjected to random copolymerization by solution polymerization with a toluene solvent obtain a coating resin G having a weight-average molecular weight Mw of 48,000.

TABLE 1

| Coating resin | | Methacrylate (1) monomer | | Methacrylate (2) monomer | | Carboxyl group-containing monomer | | Fluorine-containing monomer | |
|---|---|---|---|---|---|---|---|---|---|
| | | Type | Wt - % | Type | Wt - % | Type | Wt - % | Type | Wt - % |
| Example | A | MMA | 38 | IBMA | 50 | COOH | 2 | F | 10 |
| | B | MMA | 38 | IBMA | 40 | COOH | 2 | F | 20 |
| Comparative | C | MMA | 50 | IBMA | 50 | — | | — | |
| Example | D | MMA | 98 | — | | COOH | 2 | — | |
| | E | MMA | 50 | IBMA | 40 | — | | F | 10 |
| | F | MMA | 88 | — | | COOH | 2 | F | 10 |
| | G | — | | IBMA | 88 | COOH | 2 | F | 10 |

MMA: Methyl methacrylate;
IBMA: Isobutyl methacrylate;
TBMA: Tertiary butyl methacrylate;
COOH: Methacrylic acid;
F: Perfluorooctylethyl methacrylate Preparation of Carrier I

| | |
|---|---|
| Particulate ferrite (Mn—Mg ferrite) (volume-average particle diameter: 40 μm) | 100 parts |
| Coating resin A | 1.2 parts |
| Toluene | 14 parts |

The coating resin A is dissolved in toluene to prepare a resin coat layer-forming solution. The resin coat layer-forming solution thus prepared is then put in a vacuum dehydration type kneader together with the particulate ferrite. The mixture is then stirred for 10 minutes while the temperature thereof is being kept at 60° C. Toluene is then distilled off under reduced pressure to form a resin coat layer on the surface of the particulate ferrite. The material is then sieved through a net having a mesh of 75 μm to obtain a carrier I.

Preparation of Carrier II

| | |
|---|---|
| Particulate ferrite (Mn—Mg ferrite) (volume-average particle diameter: 40 μm) | 100 parts |
| Coating resin B | 1.2 parts |
| Toluene | 14 parts |

The coating resin B is dissolved in toluene to prepare a resin coat layer-forming solution. The resin coat layer-forming solution thus prepared is then put in a vacuum dehydration type kneader together with the particulate ferrite. The mixture is then stirred for 10 minutes while the temperature thereof is being kept at 60° C. Toluene is then distilled off under reduced pressure to form a resin coat layer on the surface of the particulate ferrite. The material is then sieved through a net having a mesh of 75 μm to obtain a carrier II.

Preparation of Carrier III

| | |
|---|---|
| Magnetic powder-dispersed carrier core (produced by TODA KOGYO CORP.) (matrix resin: phenolic resin; true specific gravity: 3.7 g/cm$^3$; volume-average particle diameter: 40 μm; saturated magnetization: 60 emu/g; shape factor SF1 (ML$^2$/A): 105) | 100 parts |
| Coating resin B | 0.7 parts |
| Toluene | 14 parts |

The coating resin B is dissolved in toluene to prepare a resin coat layer-forming solution. The resin coat layer-forming solution thus prepared is then put in a vacuum dehydration type kneader together with the magnetic powder-dispersed carrier core. The mixture is then stirred for 10 minutes while the temperature thereof is being kept at 60° C. Toluene is then distilled off under reduced pressure to form a resin coat layer on the surface of the particulate ferrite. The material is then sieved through a net having a mesh of 75 μm to obtain a carrier III.

Preparation of Carrier IV

| | |
|---|---|
| Particulate ferrite (Mn—Mg ferrite) (volume-average particle diameter: 40 μm) | 100 parts |
| Coating resin C | 1.2 parts |
| Toluene | 14 parts |

The coating resin C is dissolved in toluene to prepare a resin coat layer-forming solution. The resin coat layer-forming solution thus prepared is then put in a vacuum dehydration type kneader together with the particulate ferrite. The mixture is then stirred for 10 minutes while the temperature thereof is being kept at 60° C. Toluene is then distilled off under reduced pressure to form a resin coat layer on the surface of the particulate ferrite. The material is then sieved through a net having a mesh of 75 μm to obtain a carrier IV.

Preparation of Carrier V

| | |
|---|---|
| Particulate ferrite (Mn—Mg ferrite) (volume-average particle diameter: 40 μm) | 100 parts |
| Coating resin D | 1.2 parts |
| Toluene | 14 parts |

The coating resin D is dissolved in toluene to prepare a resin coat layer-forming solution. The resin coat layer-forming solution thus prepared is then put in a vacuum dehydration type kneader together with the particulate ferrite. The mixture is then stirred for 10 minutes while the temperature thereof is being kept at 60° C. Toluene is then distilled off under reduced pressure to form a resin coat layer on the surface of the particulate ferrite. The material is then sieved through a net having a mesh of 75 μm to obtain a carrier V.

Preparation of Carrier VI

| | |
|---|---|
| Particulate ferrite (Mn—Mg ferrite) (volume-average particle diameter: 40 μm) | 100 parts |
| Coating resin E | 1.2 parts |
| Toluene | 14 parts |

The coating resin E is dissolved in toluene to prepare a resin coat layer-forming solution. The resin coat layer-forming solution thus prepared is then put in a vacuum dehydration type kneader together with the particulate ferrite. The mixture is then stirred for 10 minutes while the temperature thereof is being kept at 60° C. Toluene is then distilled off under reduced pressure to form a resin coat layer on the surface of the particulate ferrite. The material is then sieved through a net having a mesh of 75 μm to obtain a carrier VI.

Preparation of Carrier VII

| | |
|---|---|
| Particulate ferrite (Mn—Mg ferrite) (volume-average particle diameter: 40 μm) | 100 parts |
| Coating resin F | 1.2 parts |
| Toluene | 14 parts |

The coating resin F is dissolved in toluene to prepare a resin coat layer-forming solution. The resin coat layer-forming solution thus prepared is then put in a vacuum dehydration type kneader together with the particulate ferrite. The mixture is then stirred for 10 minutes while the temperature thereof is being kept at 60° C. Toluene is then distilled off under reduced pressure to form a resin coat layer on the surface of the particulate ferrite. The material is then sieved through a net having a mesh of 75 μm to obtain a carrier VII.

Preparation of Carrier VIII

| | |
|---|---|
| Particulate ferrite (Mn—Mg ferrite) (volume-average particle diameter: 40 μm) | 100 parts |
| Coating resin G | 1.2 parts |
| Toluene | 14 parts |

The coating resin G is dissolved in toluene to prepare a resin coat layer-forming solution. The resin coat layer-forming solution thus prepared is then put in a vacuum dehydration type kneader together with the particulate ferrite. The mixture is then stirred for 10 minutes while the temperature thereof is being kept at 60° C. Toluene is then distilled off under reduced pressure to form a resin coat layer on the surface of the particulate ferrite. The material is then sieved through a net having a mesh of 75 μm to obtain a carrier VIII.

Preparation of Toner A

Preparation of Particulate Resin Dispersion (1):

| | |
|---|---|
| Styrene | 370 g |
| n-Butyl acrylate | 30 g |
| Acrylic acid | 8 g |
| Dodecanethiol | 24 g |
| Carbon tetrabromide | 4 g |

These components are mixed and dissolved to prepare a starting material solution. The starting material solution thus prepared is then added to a solution of 6 g of a nonionic surface active agent (NONIPOLE 400, produced by SANYO CHEMICAL INDUSTRIES, LTD.) and 10 g of an anionic surface active agent (NEOGEN SC, produced by Daiichi Kogyo Seiyaku Co., Ltd.) in 550 g of ion-exchanged water. The mixture is then subjected to dispersion and emulsification in a flask. To the emulsion is then added a solution of 4 g of ammonium persulfate in 50 g of ion-exchanged water with slow stirring in 10 minutes. The air within the flask is then replaced by nitrogen. The flask is then heated over an oil bath with stirring until the temperature of the content in the flask reached 70° C. Emulsion polymerization continues at a temperature of 70° C. for 5 hours to obtain a particulate resin dispersion (1).

The particulate resin thus obtained has an average particle diameter of 155 nm, Tg of 59° C. and a weight-average molecular weight Mw of 12,000.

Preparation of Particulate Resin Dispersion (2):

| | |
|---|---|
| Styrene | 280 g |
| n-Butyl acrylate | 120 g |
| Acrylic acid | 8 g |

These components are mixed and dissolved to prepare a starting material solution. The starting material solution thus prepared is then added to a solution of 6 g of a nonionic surface active agent (NONIPOLE 400, produced by SANYO CHEMICAL INDUSTRIES, LTD.) and 12 g of an anionic surface active agent (NEOGEN SC, produced by Daiichi Kogyo Seiyaku Co., Ltd.) in 550 g of ion-exchanged water. The mixture is then subjected to dispersion and emulsification in a flask. To the emulsion is then added a solution of 3 g of ammonium persulfate in 50 g of ion-exchanged water with slow stirring in 10 minutes. The air within the flask is then replaced by nitrogen. The flask is then heated over an oil bath with stirring until the temperature of the content in the flask reached 70° C. Emulsion polymerization continues at a temperature of 70° C. for 5 hours to obtain a particulate resin dispersion (2).

The particulate resin thus obtained has an average particle diameter of 105 nm, Tg of 53° C. and a weight-average molecular weight Mw of 550,000.

Preparation of Colorant Dispersion (1):

| | |
|---|---|
| Carbon black (MORGAL L, produced by Cabot Specialty Chemicals Inc.) | 50 g |
| Nonionic surface active agent (NONIPOLE 400, produced by SANYO CHEMICAL INDUSTRIES, LTD.; melting point: 85° C.) | 5 g |
| Ion-exchanged water | 200 g |

These components are mixed and dissolved. The mixture is then subjected to dispersion by means of a homogenizer (ULTRATALAX T50, produced by IKA) for 10 minutes to obtain a colorant dispersion (1) having a colorant (carbon black) having an average particle diameter of 250 nm dispersed therein.

Preparation of Release Agent Dispersion (1):

| | |
|---|---|
| Paraffin wax (HNP0190, produced by Nihon Seiro Co., Ltd.; melting point: 85° C.) | 50 g |
| Cationic surface active agent (SANIZOLE B50, produced by Kao Corp.) | 5 g |
| Ion-exchanged water | 200 g |

The foregoing components are heated to a temperature of 95° C. where it is then subjected to dispersion by means of a homogenizer (ULTRATALAX T50, produced by IKA). The dispersion is then further subjected to dispersion by means of a pressure ejection type homogenizer to obtain a release agent dispersion (1) having a release agent having an average diameter of 550 nm dispersed therein.

Preparation of Coagulated Particle Dispersion:

| | |
|---|---|
| Particulate resin dispersion (1) | 120 g |
| Particulate resin dispersion (2) | 80 g |
| Colorant dispersion (1) | 30 g |
| Release agent dispersion (1) | 40 g |
| Cationic surface active agent (SANIZOLE B50, produced by Kao Corp.) | 1.5 g |

These components are mixed in a round stainless steel flask by means of a homogenizer (ULTRATALAX T50, produced by IKA) to make dispersion. The dispersion thus obtained is then heated to a temperature of 50° C. with stirring over a heating oil bath. Thereafter, the dispersion is allowed to cool to a temperature of 45° C. where it is then kept for 25 minutes to obtain a coagulated particle dispersion. The coagulated particles thus obtained are then observed under optical microscope. As a result, the coagulated particles are found to have an average particle diameter of about 5.0 μm.

Preparation of Attached Particle Dispersion:

To the foregoing coagulated particle dispersion is then slowly added 60 g of the particulate resin dispersion (1). The temperature of the heating oil bath is raised to 50° C. where the mixture is then kept for 40 minutes to obtain an attached particle dispersion. The attached particles are then observed under optical microscope. As a result, the attached particles are found to have an average particle diameter of about 5.8 μm.

Preparation of Particulate Toner:

To the foregoing attached particle dispersion is then 3 g of an anionic surface active agent (NEOGEN SC, produced Daiichi Kogyo Seiyaku Co., Ltd.). The foregoing stainless steel flask is then sealed. With continued stirring by a magnetic seal, the content of the stainless steel is heated to a temperature of 105° C. where it is then kept for 4 hours. Thereafter, the reaction solution is cooled. The resulting reaction product is withdrawn by filtration, thoroughly washed with ion-exchanged water, and then dried to obtain a particulate toner. The particulate toner thus obtained has a volume-average particle diameter D50 of 6.0 μm and a shape factor SF1 ($ML^2/A$) of 106.

Preparation of Toner b (Molten Kneaded Toner)

| | |
|---|---|
| Styrene/n-butyl methacrylate resin (copolymerization ratio: 70:30; weight-average molecular weight Mw: 200,000; produced by SANYO CHEMICAL INDUSTRIES, LTD.) | 89 parts |
| Carbon black (MORGAL L, produced by Cabot Specialty Chemicals Inc.) | 6 parts |
| Polypropylene wax (660P, produced by SANYO CHEMICAL INDUSTRIES, LTD.) | 5 parts |

The foregoing components are then subjected to melt-knead grinding to obtain a toner b having an average particle diameter of 6 μm.

External Additive (1)

Decyl silane-treated compound of acicular rutile titanium oxide (volume-average particle diameter: 15 nm; powder resistivity: $10^{15}$ Ω·cm)

External Additive (2)

Spherical monodisperse silica obtained by treating silica sol obtained by sol-gel process with HMDS, and then drying and grinding the silica (shape factor SF1: 105; volume-average particle diameter: 135 μm; powder resistivity: $10^{15}$ Ω·cm)

Example 1 to 3 and Comparative Examples 1 to 6

Preparation of Developers

To 100 parts by weight of each of the foregoing various particulate toners are then added 1 part of the external additive (1) and 1 part of the external additive (2). Using a Henschel mixer, these components are then blended at a rate of 30 m/sec. for 10 minutes. The mixture is then sieved through a sieve having a mesh of 45 μm to remove coarse particles therefrom to prepare external toners a and b.

7 parts by weight of the external toners a and b and 100 parts by weight of the carriers I to III are blended, respectively, with stirring at a rate of 40 rpm for 20 minutes. The mixture is then sieved through a sieve having a mesh of 125 μm to obtain developers of Examples 1 to 3 and Comparative Examples 1 to 5 set forth in Table 2.

TABLE 2

| Example No. | Carrier (coating resin) | Toner | Sleeve (μm) |
|---|---|---|---|
| Example 1 | I (A) | a | Rz = 20, Ra = 3 |
| Example 2 | II (B) | a | Rz = 20, Ra = 3 |
| Example 3 | II (B)*1) | a | Rz = 20, Ra = 3 |
| Comparative Example 1 | IV (C) | a | Rz = 20, Ra = 3 |
| Comparative Example 2 | V (D) | a | Rz = 20, Ra = 3 |
| Comparative Example 3 | VI (E) | a | Rz = 20, Ra = 3 |
| Comparative Example 4 | VII (F) | a | Rz = 20, Ra = 3 |
| Comparative Example 5 | VIII (G) | a | Rz = 20, Ra = 3 |
| Comparative Example 6 | III (B)*1) | b*2) | Rz = 20, Ra = 3 |
| Comparative Example 7 | III (B)*1) | a | Rz < 2, Ra < 0.2 |

*1)Magnetic powder-dispersed carrier core is used

*2)Molten-kneaded toner comprising styrene/n-butyl methacrylate resin

Magnetic Sleeve for Carrying Developer

For the evaluation of Comparative Example 7, a magnetic sleeve for carrying developer free of unevenness having Rz of less than 2 μm and Ra of less than 0.2 μm is used to form an image. For the comparison of Examples 1 to 3 and Comparative Examples 1 to 6, a magnetic sleeve having a fine unevenness having Rz of 20 μm and Ra of 3 μm is used to form an image. The Rz and Ra values of the magnetic sleeves, too, are set forth in Table 2. Rz represents a value averaged over measurements made on 10 points. Ra represents a central line average roughness.

Environmental Dependence Test

The developers of Examples 1 to 3 and Comparative Examples 1 to 6 are each applied to a Type A Color 936 developing machine produced by Fuji Xerox Co., Ltd., and then allowed to stand overnight under high temperature and humidity conditions (28° C., 80RH %) and low temperature and humidity conditions (10° C., 15RH %). Under these conditions, the developing machine is then operated idle for 30 minutes to evaluate the electrification of the developers. The evaluation of electrification is effected by flow-off method.

In accordance with blow-off process, 0.5 g of the sample is put in a metal gauge having a capacity of 30 ml formed by a net having a mesh of 18 μm on the upper and lower part thereof. The sample is then blown off in a nitrogen gas at 3 atm. The resulting electric charge is then measured by a type 6517A electrometer (produced by Keithley Instruments, Inc.). The measurements are then substituted in the following equation to calculate charged amount. The results are set forth in Table 4.

Charged amount=Measured charge/((Weight of gauge before blow off)−(Weight of gauge after blow off))

TABLE 3

| Example No. | Charged amount (μC/g) (1) High temp. & high humid. | (2) Low temp. & low humid. | Ratio of (1)/(2) | Evaluation of environmental dependence |
|---|---|---|---|---|
| Example 1 | −32.8 | −35.2 | 0.93 | G |
| Example 2 | −30.2 | −32.3 | 0.93 | G |
| Example 3 | −33.0 | −34.1 | 0.97 | G |
| Comparative Example 1 | −30.4 | −43.8 | 0.69 | P |
| Comparative Example 2 | −16.7 | −36.5 | 0.46 | P |

TABLE 3-continued

| Example No. | Charged amount (μC/g) (1) High temp. & high humid. | (2) Low temp. & low humid. | Ratio of (1)/(2) | Evaluation of environmental dependence |
|---|---|---|---|---|
| Comparative Example 3 | −26.4 | −40.6 | 0.67 | P |
| Comparative Example 4 | −14.7 | −35.5 | 0.41 | P |
| Comparative Example 5 | −31.8 | −35.6 | 0.89 | F |

Criterion for evaluation of charge
G: Good
F: Slight environmental dependence observed
P: Poor Results of Evaluation of Environmental Dependence As can be seen in Table 3, the developers of Examples 1 and 2 exhibit a very good electrostatic property under high temperature and humidity conditions and under low temperature and humidity conditions and an excellent environmental stability. On the other hand, the developer of Comparative Example 1 is observed to have an increase of charged amount under low temperature and humidity conditions and hence leave something to be desired in environmental dependence. The developer of Comparative Example 2 is observed to have a considerably low charged amount under high temperature and humidity conditions and hence leave much to be desired in environmental dependence. Both the developers of Comparative Examples 3 and 4 exhibit a high environmental dependence. The developer of Comparative Example 5 exhibits some environmental dependence.

Test on Electrification Maintenance and Image Maintenance

The developers of Examples 1 to 3 and Comparative Examples 1 to 6 are each allowed to stand under high temperature and humidity conditions (28° C., 80RH %) and low temperature and low humidity conditions (10° C., 15RH %) overnight, and then applied to a Type A Color 936 developing machine produced by Fuji Xerox Co., Ltd. Under these conditions, 50,000 sheets of images are then developed. The 1st sheet of image sample and the 50,000th sheet of image sample are then evaluated for image quality and electrostatic property. The results are set forth in Table 4.

TABLE 4

| Example No. | Charged amount (μC/g) under high temp. & high humid. conditions/image quality: Initial | At 50,000th sheet | Charged amount (μC/g) under low temp. & low humid. conditions/image quality: Initial | At 50,000th sheet | Total evaluation |
|---|---|---|---|---|---|
| Example 1 | −32.3/E | −29.2/G | −35.4/E | −33.5/E | E |
| Example 2 | −30.8/E | −29.4/G | −34.2/E | −33.5/E | E |
| Example 3 | −31.6/E | −29.8/G | −32.8/E | −31.4/E | E |
| Comparative Example 1 | −30.1/E | −22.0/P (Film peeling/toner scattering) | −42.0/G | −26.2/P (Film peeling/toner scattering) | P |
| Comparative Example 2 | −18.1/F | −12.8/P (Contamination by toner/fogging) | −37.0/G | −30.2/G | P |
| Comparative Example 3 | −27.3/E | −20.0/P (Film peeling/toner scattering) | −41.2/G | −25.5/P (Film peeling/toner scattering) | P |
| Comparative Example 4 | −14.6/P (toner scattering) | −11.5/P (Toner scattering) | −36.2/G | −25.6/P (Toner scattering) | P |

TABLE 4-continued

| Example No. | Charged amount (μC/g) under high temp. & high humid. conditions/image quality | | Charged amount (μC/g) under low temp. & low humid. conditions/image quality | | Total evaluation |
|---|---|---|---|---|---|
| | Initial | At 50,000th sheet | Initial | At 50,000th sheet | |
| Comparative Example 5 | −31.0/G | −22.6/P (Admix defect/toner blown out) | −36.4/G | −28.5/G | P |
| Comparative Example 6 | −21.9/P (Image quality deterioration) | −16.8/P (Toner scattering) | −32.2/P (Image quality deterioration) | −22.5/P (Toner scattering) | P |

Criterion for image quality
E: Very good
G: Good
F: Slightly poor
P: Poor

Results of Evaluation of Electrification Maintenance and Image Maintenance

As can be seen in Table 4, the developers of Examples 1 to 3 exhibit very excellent electrostatic property and image quality at the initial image development and good electrostatic property and image quality at the 50,000th sheet both under high temperature and high humidity conditions and low temperature and low humidity conditions.

On the other hand, the developer of Comparative Example 1 exhibits good electrostatic property and image quality at the initial image development both under high temperature and high humidity conditions and low temperature and low humidity conditions but shows peeling of resin coat from carrier and carrier scattering at the 50,000th sheet. The developer of Comparative Example 2 exhibits slightly good electrostatic property and image quality at the initial image development under low temperature and low humidity conditions but deteriorated charged amount and slightly deteriorated image quality at the initial image development under high temperature and high humidity conditions. Further, the charged amount at the 50,000th sheet under high temperature and high humidity conditions is deteriorated. Thus, the surface of the carrier is found contaminated by the toner. Therefore, image fog is observed.

The developer of Comparative Example 3 gives the same electrostatic property and image quality as that of Comparative Example 1 but causes toner scattering at earlier time than that of Comparative Example 1. The developer of Comparative Example 4 exhibits a reduced charged amount and causes toner scattering at early stage under high temperature and high humidity conditions to disadvantage. The developer of Comparative Example 5 exhibits good charged amount and image quality at the initial stage but causes the toner to be blown out at around 1,000th sheet under high temperature and high humidity conditions, producing admix defect. The developer of Comparative Example 6 exhibits a god initial chargeability but shows a poor initial image quality and causes the toner to be scattered at the 50,000th sheet and after under high temperature and high humidity conditions.

Conveyance Stability Test

The developer of Example 3 is applied to a Type A Color 936 developing machine produced by Fuji Xerox Co., Ltd. on which a magnetic sleeve for carrying developer (diameter: 18 cm) having a fine unevenness having Rz of 20 μm and Ra of 3 μm has been mounted. The developer is then examined for conveyability under normal temperature and humidity conditions (20° C., 50RH %). The foregoing developer is also applied to the same developing machine on which a magnetic sleeve for carrying developer free of unevenness having Rz of less than 2 μm. The developer is then similarly examined for conveyability. For the adjustment of the amount of the developer, a frame is formed centering on the area in contact with the photoreceptor by a fixture having a size of 8 mm length×62.5 mm width. The developer within the frame is taken by a magnet. By adjusting the distance between the developer regulating plate and the sleeve, the amount of the developer is controlled to a range of 400 $g/m^3$±20 $g/m^3$. For the evaluation of conveyance stability, the difference in the amount of developer per unit area between at the upstream shortly after the outlet of the regulating plate and at the downstream is determined. The results are set forth in Table 5.

TABLE 5

| Example No. | Sleeve Rz/Az (μm) | Amount of developer per unit area: At upstream | Amount of developer per unit area: At downstream | Evaluation of image quality | Judgment |
|---|---|---|---|---|---|
| Example 3 | 20/3 | 398 $g/m^2$ | 412 $g/m^2$ | E | E |
| Comparative Example 7 | <2/ <0.2 | 189 $g/m^2$ | 586 $g/m^2$ | P (Carrier scattering) | P |

Criterion for conveyance stability
E: Very good
G: Good
F: Slightly poor
P: Poor Results of Evaluation of Conveyance Stability As can be seen in Table 5, Example 3, which uses a magnetic sleeve for carrying developer having a fine unevenness, provides desired amount of developer both at the upstream and downstream, showing a good conveyance stability. On the contrary, Comparative Example 7, which uses a magnetic sleeve for carrying developer free of unevenness, provides a reduced amount of developer at the upstream and thus causes the carrier to be scattered.

In accordance with the present invention, the use of the foregoing constitution makes it possible to provide a carrier for the development of electrostatic latent image excellent in electrostatic property, electrification-maintaining property, environmental stability, durability and pollution resistance and hence form a high quality image.

While the invention has been described in detail and with reference to specific embodiments thereof, it will be apparent to one skilled in the art that various changes and modifications can be made therein without departing from the spirit and scope thereof.

What is claimed is:

1. A carrier for the development of an electrostatic latent image, comprising a core material and a resin coating said core material therewith, wherein said coating resin comprises a copolymer comprising:

(1) a monomer containing a carboxyl group;

(2) an acrylic acid alkylester monomer or methacrylic acid alkylester monomer, containing a $C_1$–$C_3$ linear alkyl group;

(3) an acrylic acid alkylester monomer or methacrylic acid alkylester monomer, selected from the group consisting of isopropyl (meth)acrylate, tertiary butyl (meth)acrylate, isobutyl (meth)acrylate, tertiary pentyl (meth)acrylate, isopentyl (meth)acrylate, isohexyl (meth)acrylate, and cyclohexyl (meth)acrylate; and (4) a monomer containing fluorine selected from the group consisting of acrylic acid fluoroalkylester monomer and methacrylic fluoroalkylester.

2. The carrier according to claim 1, wherein the proportion of said carboxyl group-containing monomer (1) is from 0.1 to 20.0 parts by weight per 100 parts by weight of said copolymer.

3. The carrier according to claim 1, wherein the proportion of said fluorine-containing monomer (4) is from 0.1 to 60.0 parts by weight per 100 parts by weight of said copolymer.

4. The carrier according to claim 1, wherein the ratio of said monomer (2) to said monomer (3) is from 10:90 to 90:10.

5. The carrier according to claim 1, wherein said core material has a shape factor SF1 of not greater than 125, a true specific gravity of from 3 to 5 g/cm$^3$ and a saturated magnetization of not smaller than 40 emu/g.

6. The carrier according to claim 1, wherein said core material is a magnetic powder-dispersed spherical core material.

7. A two-component developer for the development of an electrostatic latent image comprising a toner and a carrier, wherein said carrier is according to claim 1.

8. The two-component developer according to claim 7, wherein said toner comprises a binder resin containing a carboxylic group-containing monomer.

9. The two-component developer according to claim 7, wherein said toner is produced by a wet process.

10. The carrier according to claim 1, wherein the coating resin coats the carrier core in an amount between 0.05 to 5.0% by weight of the carrier.

11. The carrier according to claim 1, wherein the monomer containing fluorine is selected from the group consisting of tetrafluoropropyl methacrylate, pentafluoropropyl methacrylate, octafluoropentyl methacrylate, perfluorooctylethyl methacrylate and trifluoroethyl methacrylate.

12. An image formation method comprising:

forming an electrostatic latent image on an electrostatic latent image holding member;

developing said electrostatic latent image with a developer on a developer holding member to form a toner image;

transferring said toner image to a transfer material; and fixing said toner image on said transfer material, wherein said developer contains a toner end a carrier according to claim 1.

13. The image formation method according to claim 12, wherein said toner comprises a binder resin containing a carboxylic group-containing monomer.

14. The image formation method according to claim 12, wherein said toner is produced by a wet process.

15. The image formation method according to claim 12, wherein said developer holding member has a fine unevenness having a 10-points average roughness Rz of from 15 to 25 $\mu$m and a center line average roughness Ra of from 1 to 5 $\mu$m.

* * * * *